US005425218A

United States Patent [19]

Adams et al.

[11] Patent Number: 5,425,218

[45] Date of Patent: Jun. 20, 1995

[54] METHOD FOR MAKING A HEATSEALABLE CARTON

[75] Inventors: John M. Adams, Mechanicsville, Va.; Angel Amendola, Millersville, Md.; Frederick M. Della Crosse, White Plains, N.Y.; Robert Gallino, Englewood Cliffs, N.J.; Jeffrey M. S. Haskin, LaGrange, Ga.; David Moir, Annapolis, Md.; Xuan M. Pham, Richmond; Kenneth B. Shepard, Chesterfield, both of Va.; Ronald R. Stewart, Goshen, Ky.

[73] Assignee: Philip Morris Management Corp., Richmond, Va.

[21] Appl. No.: 81,973

[22] Filed: Jun. 23, 1993

Related U.S. Application Data

[63] Continuation-in-part of Ser. No. 3,846, Jan. 11, 1993, Pat. No. 5,249,416, which is a continuation of Ser. No. 700,759, May 15, 1991, abandoned.

[51] Int. Cl.[6] ..... B65B 51/10; B65B 51/32

[52] U.S. Cl. ..... 53/463; 53/376.7

[58] Field of Search ..... 53/387.3, 387.4, 376.7, 53/376.6, 377.8, 377.7, 462, 456, 477, 476, 484, 207, 209, 444, 447, 148, 543

[56] References Cited

U.S. PATENT DOCUMENTS

| | | | |
|---|---|---|---|
| 2,874,619 | 2/1959 | Phin | 53/376.7 X |
| 3,002,329 | 10/1961 | Cookson et al. | 53/376.7 |
| 3,777,448 | 12/1973 | Howe | 53/376.7 X |
| 3,977,306 | 8/1976 | Flynn | 53/376.7 X |

OTHER PUBLICATIONS

"GD-4350/Pack B-OW" Brochure, (no date).

*Primary Examiner*—James F. Coan

*Attorney, Agent, or Firm*—Charles E. B. Glenn; James E. Schardt

[57] ABSTRACT

A sealed cigarette carton is formed by activating an adhesive pre-applied to a carton blank and then setting the adhesive. Cigarette packaging apparatus and method utilizing packaging stock comprising a pre-applied adhesive forms cigarette cartons that are sealed by heat-activating and then setting the pre-applied adhesive.

3 Claims, 4 Drawing Sheets

METHOD FOR MAKING A HEATSEALABLE CARTON

CROSS REFERENCE TO RELATED APPLICATION

This application is a continuation-in-part of commonly-assigned U.S. patent application Ser. No. 08/003,846, filed Jan. 11, 1993, now U.S. Pat. No. 5,249,416 which is a continuation of U. S. Pat. application Ser. No. 07/700,759, filed May 15, 1991 and now abandoned, which are both hereby incorporated by reference in their entireties.

Background of the Invention

The present invention relates to cartons for packaging and to an apparatus and method for packing cigarette packs or other materials into cartons and sealing the cartons with pre-applied adhesives. More particularly, the present invention relates to manufacturing cartons whereby the packaging stock is printed or otherwise coated with adhesive before it is supplied to the packaging machine and the machine later provides means for activating and setting the adhesive. Known wet adhesive carton packing machines may be modified to practice the present invention by removing or disabling the wet adhesive application apparatus and adding apparatus as required to activate and set the pre-applied adhesive.

Carton packing machines are widely used in high speed manufacturing operations, such as cigarette packaging. In a typical commercial wet adhesive ("wet-glue") cigarette carton packing machine, a commercial wet adhesive is applied to pre-cut carton blanks at specified positions and the carton blanks are then folded around a pre-assembled bundle of cigarette packs. Water-based or other solvent-based or wax-based wet adhesives are commonly used. Wet-glue cigarette carton packing machines are widely known, and exemplary versions are assigned to G.D. Societa per Azioni, Via Pomponia 10, 40100 Bologna, Italy, which sells a commercial carton packing machine under the model designation GD-4350/PACK B-OW.

In typical known wet-glue carton packing machines, pre-cut cigarette carton blanks are released from a hopper one at a time. Wet glue is then applied to each carton blank at edges corresponding to the erected carton's end flaps and bottom tabs. The carton blanks are then folded around a bundle of cigarette packs, typically ten in number arranged in two rows of five packs each. The group of cigarette packs, which has been overwrapped in cellophane, impinges upon the blank, folding the blank at score lines that become the bottom edges of the carton, thereby forming the bottom, front and back walls of the carton. The blank-enclosed bundle is then moved onto an exit ramp apparatus where the side flaps and bottom tabs of the carton are folded over the sides of the cigarette pack bundle and where the wet glue on these flaps and tabs is set and held in place by side conveyor belts that move the cartons off the exit ramp.

Wet-glue carton packing machines possess a number of known disadvantages. One such disadvantage is slippage, which occurs when opposing portions of the carton stock move with respect to each other before the wet glue is set such that the desired predetermined alignment is not achieved. Slippage is undesirable because the resulting cartons may be improperly sealed, may be wrinkled or may have an otherwise displeasing appearance.

Clogging is another disadvantage of wet-glue machines and occurs either when the apparatus used to apply the wet glue becomes blocked or when wet glue causes the downstream processing apparatus to become clogged. When clogging occurs, the machine must be stopped and cleaned, resulting in productivity loss.

Smearing is a further disadvantage of wet-glue carton packing machines. Smearing occurs, for example, when glue seeps out from glued seams, when it smears from its position or when it slings. Smeared cartons can have a dirty or otherwise undesirable appearance.

Yet another disadvantage of wet-glue machines is product loss from machine stoppages. As with many complex machines, wet-glue machines are often stopped for resupply, personnel changes, declogging or other maintenance. Each time the machine is stopped, uncompleted cartons must be rejected because the glue that has been applied to the carton blanks that are still being processed may dry during the machine stoppage, rendering them unusable.

A further disadvantage of wet-glue carton packaging machines is a lack of flexibility regarding the placement of the adhesive. In wet-glue machines, the glue is applied by glue daubers, and the carton blanks are directed to the daubers by guides. However, the glue placement by the daubers must avoid the guides. Also, the processing apparatus must be constructed such that mechanical elements downstream of where the glue is applied do not contact the wet glue.

Still other disadvantages of wet-glue packaging machines are: difficulty in controlling the amount of glue that is applied, high viscosity of the glue itself, glue build-up along guides and frequent maintenance required by the glue application apparatus.

SUMMARY OF THE INVENTION

The present invention alleviates to a great extent the disadvantages of the prior art by providing a cigarette carton packaging machine that utilizes packaging stock partially coated with a pre-applied adhesive to form cartons that are sealed by activating the pre-applied adhesive. In the carton packing machine of the present invention, cartons of the present invention are formed by wrapping carton blanks having a pre-applied adhesive around a pre-arranged bundle of cigarette packs and then sealing the cartons by activating the pre-applied adhesive, such as through the application of heat, and setting the adhesive, such as by cooling below the activation temperature.

The packaging apparatus of the present invention may incorporate any processing apparatus that forms carton packaged bundles. In a preferred version of this invention, a known wet-glue carton packing machine is modified. The modifications include elimination or disabling of the apparatus for handling and applying wet glue and addition of apparatus for activating and setting pre-applied adhesive.

The present invention was disclosed as an embodiment of copending commonly-assigned patent application Ser. No. 08/003,846, which claimed a method and apparatus for making cigarette packs using pre-applied dry adhesives and the cigarette pack formed therein.

An advantage of the present invention is that glue application apparatus, such as glue dauber assemblies, glue rollers, scraper assemblies, glue pots, glue fill assemblies and glue pot sensors, can be eliminated from carton packaging machines, thus making the machines less costly, simpler, easier to maintain and less prone to failure.

Another advantage of the present invention is that pre-applied adhesive, which is substantially non-tacky after it has been applied and until activated, is used rather than wet glue. Use of such a substantially non-tacky pre-applied adhesive eliminates the problems of slippage, smearing and clogging that occur in wet-glue machines.

A further advantage is greater flexibility in positioning the adhesive and in designing the apparatus because the limitations inherent in wet glue application systems are eliminated. In particular, there is no need to avoid the glue daubers or to avoid handling the adhesive side of the packaging stock. A resulting further advantage is that a stronger seal can be achieved because a longer area may be covered by the pre-applied adhesive.

Still a further advantage of the present invention is that fewer packs are damaged due to machine stoppages, because the problem of wet glue drying out during machine stoppages is eliminated.

It is therefore an objective of the present invention to provide a carton sealed with a pre-applied dry adhesive. It is also an objective of the present invention to provide an apparatus and method for packing cigarette packs into cartons having pre-applied adhesive and for activating and setting the pre-applied adhesive.

BRIEF DESCRIPTION OF THE DRAWINGS

The above and other objects and advantages of the invention will be apparent upon consideration of the following detailed description, taken in conjunction with the accompanying drawings in which like reference characters refer to like parts throughout and in which.

DETAILED DESCRIPTION OF THE INVENTION

A sealed carton is formed by activating an adhesive pre-applied to a carton blank and then setting the adhesive. In one embodiment of the carton packing machine of the present invention, a heat activated adhesive is pre-applied to carton blanks, and the blanks are then wrapped around bundles of cigarette packs. The carton-wrapped bundles pass through an exit ramp apparatus that includes at least one heater on each side to activate the adhesive and at least one cooler on each side to set the adhesive. Two side conveyor belts move the cartons along the exit ramp apparatus, while applying pressure to set the adhesive.

Figure 1:
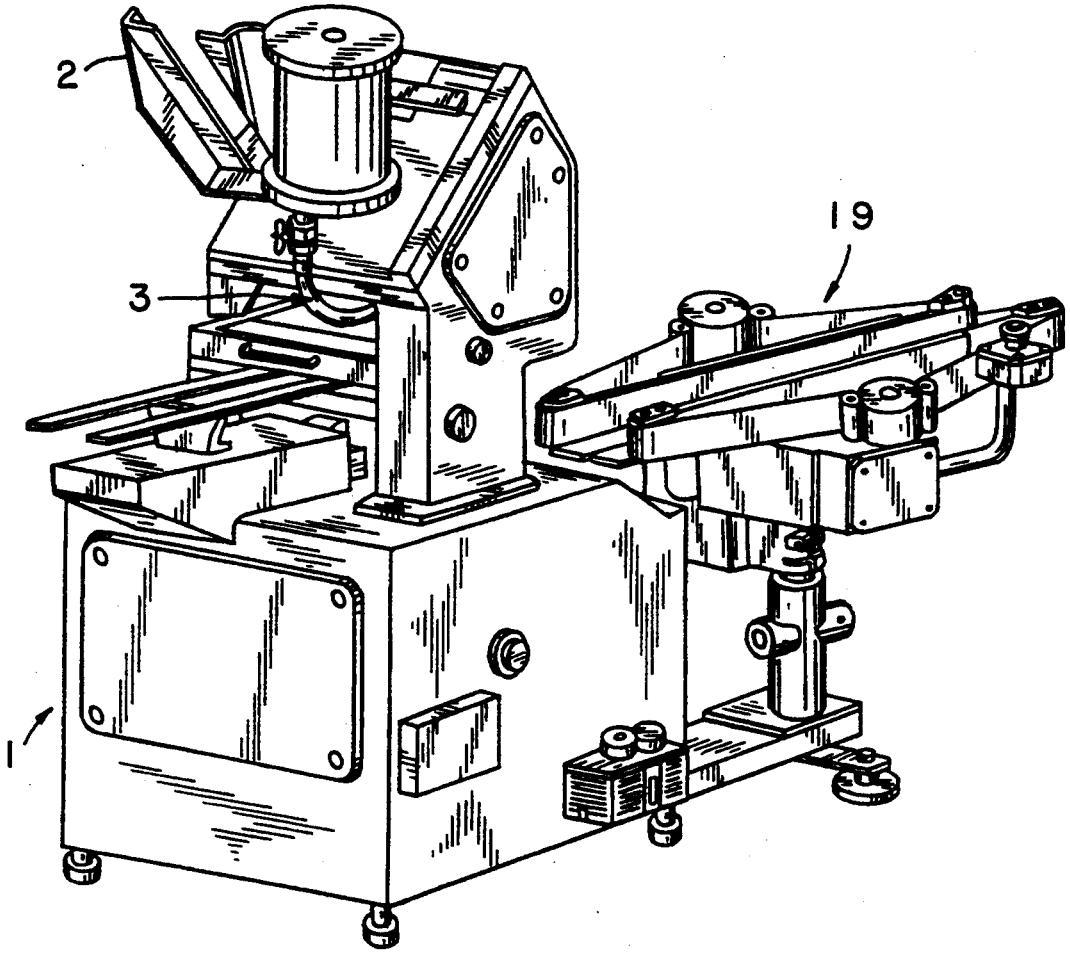
FIG. 1 PRIOR ART
FIG. 1 is a side perspective view of a known carton packaging machine.

Any method and processing apparatus that forms carton packaged cigarette pack bundles may be used in conjunction with the present invention. In a preferred embodiment, a known wet-glue carton packaging machine is modified and used. For example, U.S. patent application Ser. No. 08/003,846 discloses applicable wet-glue methods and apparatus. A known wet-glue carton packer 1, shown in FIG. 1, is preferred.

In the example of a known wet-glue carton packer 1, a carton blank is released from a hopper 2 and coated at desired locations of the blank with a wet adhesive. Accordingly, those wet-glue systems incorporate glue application apparatus 3, including a glue dauber assembly, glue roller, glue scraper assembly, glue pot, glue fill assembly and glue pot sensor, which are used to apply the wet glue to the carton blanks before they are wrapped around cellophane-wrapped cigarette pack bundles.

In the cigarette pack carton packaging machine that is the subject of the present invention, however, the adhesive is pre-applied (and dried) on the carton blanks before the blanks are delivered to the carton packer. No wet-glue application apparatus is required or desired. Thus, a wet-glue packer may be modified by removing or disabling the wet-glue application apparatus.

Any type of adhesive that can be pre-applied to packaging stock and activated in a packaging machine may be used. Among the possible adhesives are those which can be activated by heat, lasers, ultrasonic waves, infrared radiation, friction, or heated air. In the preferred embodiment, heat activated adhesives are used. Preferably, the activation temperature is above typical ambient temperatures so that the adhesive is not activated in normal handling or storage conditions. For example, many of the known emulsion heat seals, hot melts or solvent-based adhesives may be used, such as ethylene vinyl acetate copolymers, acrylics, polyolefin copolymers and ionomers.

It is preferred that the adhesive be capable of forming a positive seal within 0.1–0.2 seconds at heater temperatures of approximately 100°–160° C. and at pressures between 1 and 30 psi. It also is preferred that, if pre-cut or stacked carton blanks are used, the adhesive coating be resistant to blocking when the labels are stacked. One suitable heat activated adhesive is No. 4408-01A by Findley Adhesives, Inc., 11320 Watertown Plank Road, Wauwatosa, Wis. 53226-3413, an adhesive which typically activates at temperatures as low as 90° C. This adhesive is the adhesive recommended for use in prior copending commonly-assigned patent application Ser. No. 08/003,846 to seal a heat-sealable cigarette pack.

Figure 2:
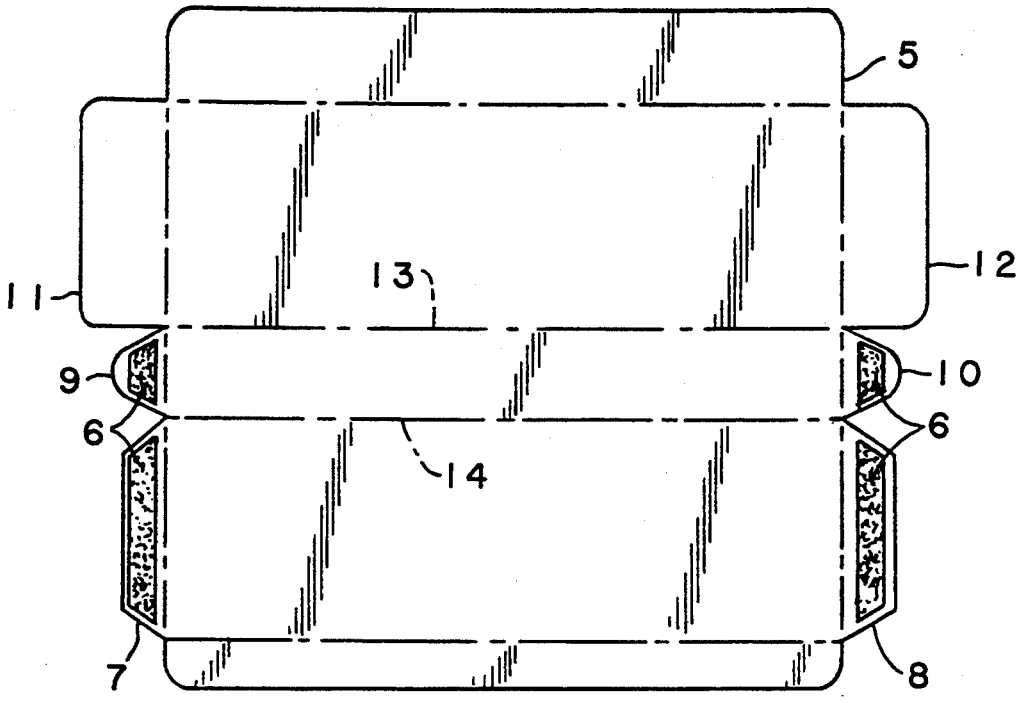
FIG. 2 is a top view of a carton blank having pre-applied adhesive according to the present invention.

The adhesive is pre-applied to the carton stock through any process of applying adhesives. In the preferred embodiment, the adhesive is printed using a gravure process and apparatus. In such a gravure process, a print roll is constructed with a pattern of cells corresponding to the position of the adhesive that are to be applied to the stock. Adhesive is positioned such that when cigarette cartons using the printed stock are assembled, seals are formed at the locations desired. FIG. 2 illustrates an example of the placement of adhesive 6 on portions of a cigarette carton blank 5 that will be the side flaps 7, 8 and bottom flaps 9, 10 of the carton when assembled. In operation, an adhesive is applied to a portion of the print roll such that it fills the cells. Stock contacts the roll such that an amount of the adhesive that is in the cells transfers to the stock. The adhesive is dried and the carton stock is cut into blanks and stacked. Alternative adhesive application methods, such as flexography, offset printing and stamping, also may be used.

Figure 3:
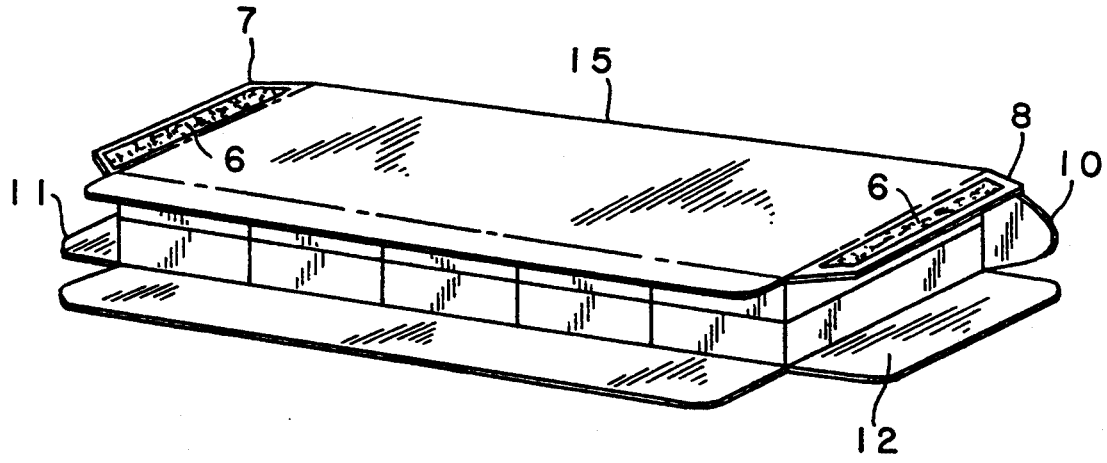
FIG. 3 is a side perspective view of a bundle of cigarette packs partially enclosed by a carton blank.

The carton blanks 5, shown in FIG. 2, having pre-applied dry adhesive 6 are released one at a time from a hopper 2 and are folded around pre-arranged bundles of cigarette packs. Each bundle, typically consisting of ten cigarette packs arranged in two rows of five packs each and overwrapped in cellophane, is pushed forward so that it impinges horizontally upon one vertically oriented blank, folding the blank at two score lines 13, 14 that become the bottom edges of the carton and thereby forming the bottom, front and back walls of the carton and a partially-enclosed bundle 15, shown in FIG. 3. Each blank-enclosed bundle 15 is further pushed forward onto an exit ramp apparatus 19, shown in FIGS. 4 and 5, where flap folding apparatus 20 folds and holds the bottom tabs 9, 10 and side flaps 7, 8 of the carton blank 5 over the sides of the enclosed cigarette pack bundle 15, and where flap folding apparatus 21 folds and holds the side walls 11, 12 of the carton blank 5 over bottom tabs 9, 10 and over side flaps 7, 8, thereby forming a carton.

Figure 4:
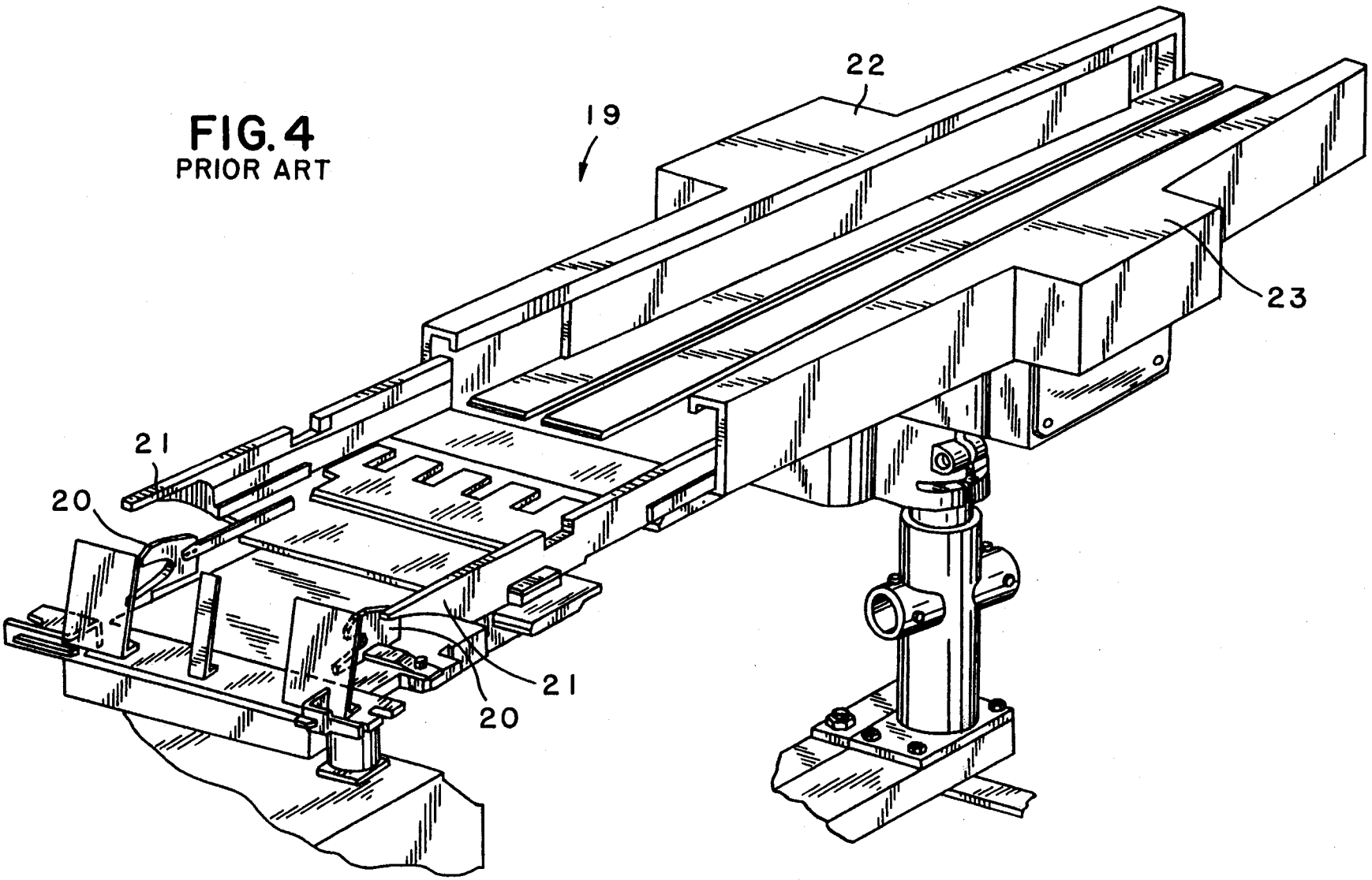
FIG. 4 PRIOR ART
FIG. 4 is a top, side, entrance-end perspective view of the exit ramp apparatus of a known carton packaging machine.

In the known wet-glue carton packaging machine 1, the cartons are then moved along the exit ramp 19 shown in FIG. 4 by two side conveyor belts 22, 23, which serve to set the wet glue on the cartons' side flaps and bottom tabs through the pressure of the belts on the sides of the cartons. The exit ramp apparatus of the carton packaging machine of the present invention, however, comprises apparatus to activate and set the pre-applied adhesive. Whereas the wet-glue carton packer uses the pressure of the side conveyor belts to set the wet adhesive, in the preferred embodiment of this invention the adhesive is heat activated and will be neither activated nor set by the side conveyor belt pressure. Therefore, in the preferred embodiment, shown in FIG. 5, at least one heating element 25, 26 is positioned on each side of the exit ramp apparatus in order to activate the pre-applied dry adhesive. Just downstream of the heating elements on the exit ramp apparatus, at least one cooling element 27, 28 is positioned on each side of the exit ramp apparatus in order to set the activated adhesive.

The heating elements 25, 26 are heated by any heat source, such as electricity, steam or gas. Preferably, electricity is used. The temperature of the heater is set such that the pre-applied adhesive is activated. The temperature selected depends upon the activation temperature of the adhesive used, the heat transfer characteristics of the adhesive-coated carton stock, the thickness of the carton stock, the operating speed of the machine, the total dwell time (the time for which each carton contacts a heating element) and the pressure applied to the seal. In the carton packer of the present invention, pressure is applied by the force exerted by the cigarette pack bundle on the inside surfaces of the side flaps and bottom tabs and by the opposing force exerted by the heating element on the outer surfaces of those flaps and tabs. In the preferred embodiment, the Findley No. 4408-01A adhesive is activated by setting the heater to 130°–150° C., with a total dwell time of 0.4–1.0 seconds and a pressure sufficient to effect a seal.

Acceptable seals can be achieved with the present invention without use of forced cooling. However, the proportion of acceptable seals can be increased if forced cooling is used to accelerate setting of the adhesive. The cooling elements 27, 28 may be set at any temperature below the activation temperature of the adhesive used, preferably such that when the pack leaves the cooler, the adhesive is substantially set. The side conveyor belts 22, 23 may be used to additionally set the seal through pressure once the seals have cooled sufficiently.

Figure 5:
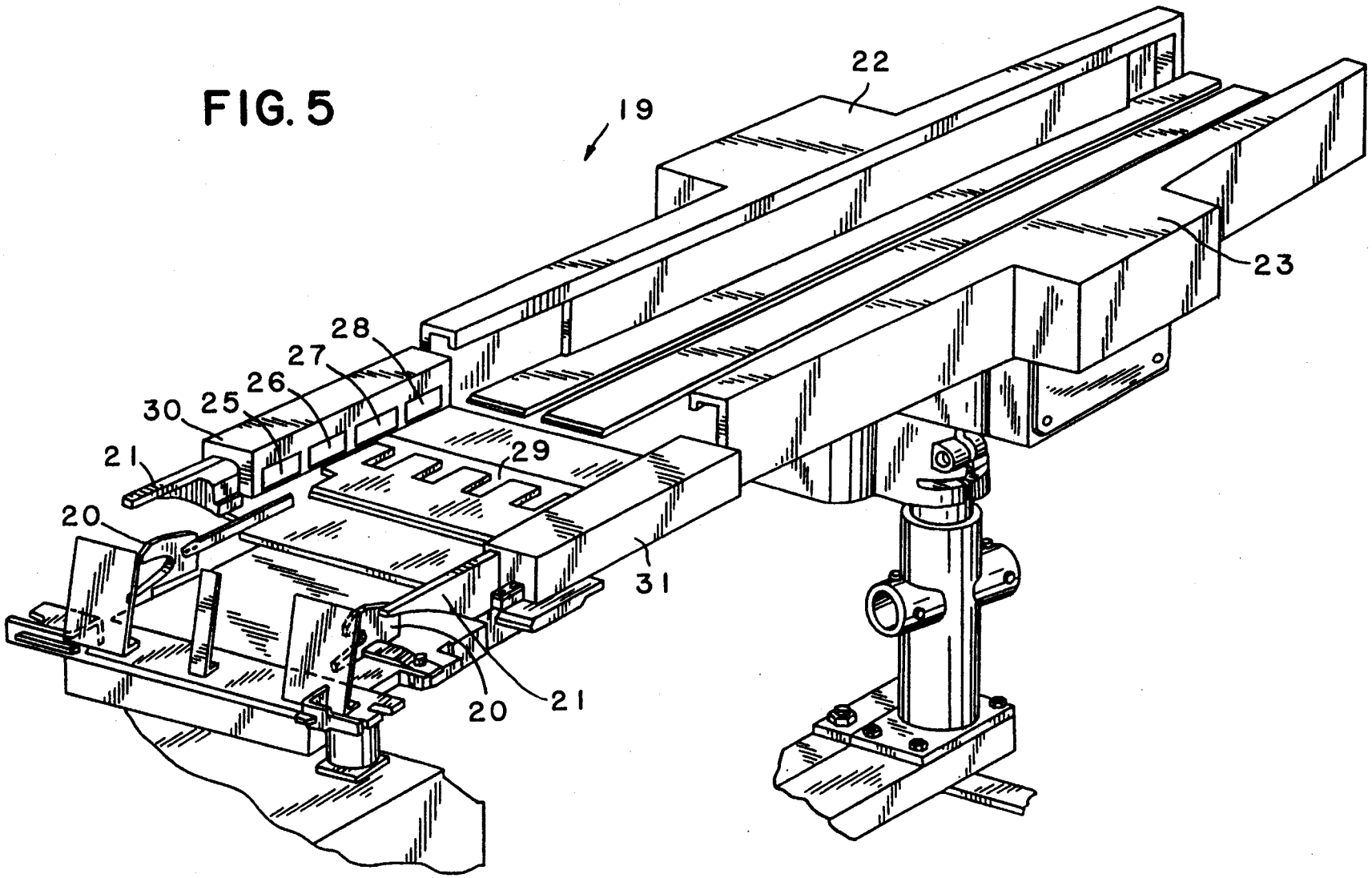
FIG. 5 is a top, side, entrance-end perspective view of a preferred embodiment of the exit ramp apparatus of a carton packaging machine of the present invention.

In a further preferred embodiment, two successive heaters 25, 26 and two successive coolers 27, 28 are added to the exit ramp, as shown in FIG. 5. Having two heating elements enables each carton to spend only half the dwell time required for activation of the adhesive in contact with each heating element, the total dwell time remaining constant, thereby effectively doubling the number of cartons that can be formed in a certain time period. In this embodiment, the heating and cooling section 29 of the exit ramp 19 is long enough so that at least four cartons can fit on the exit ramp 19 at once — two cartons being heated to activate the pre-applied adhesive and two cartons being cooled to set their adhesive. The heating and cooling elements 25–28 may even be housed together in a control box 30, 31 that allows the contact surfaces of the heating and cooling elements to contact the cartons.

Because the exit ramp 19 requires additional space for the heating and cooling elements 25–28, whether there are one or two of each, the exit ramp 19 may be further modified by extending the exit ramp area between the flap folding apparatus 21 and the conveyor belts 22, 23 in order to accommodate the heating and cooling elements 25–28. This may be accomplished either by adding sections to the exit ramp bottom surface 29 or by trimming the flap folding apparatus 21 so that the additional heating and cooling elements may fit in the preexisting space.

Each blank-enclosed bundle 15 that is pushed onto the exit ramp apparatus 19 for flap folding pushes the preceding bundle, whose carton was just completed, further along the exit ramp into the path of the heating and cooling elements for activation and setting of the adhesive. Thus, each carton is pushed by the cartons behind it on the exit ramp and progresses from the first heating element to the second. During the brief period of contact of each carton to the heating elements, the adhesive on each carton is activated. Each carton is further moved by the cartons behind it to the two successive cooling elements. During the brief contact of each carton to the cooling elements, the activated adhesive seal is set. The sealed cartons are then further moved by the two side conveyor belts 22, 23 from the cooling elements 27, 28 to the end of the exit ramp apparatus.

Thus it is seen that an apparatus and method for manufacturing cigarette cartons using pre-applied adhesive is provided. One skilled in the art will appreciate that the present invention can be practiced by other than the preferred embodiments, which are presented for purposes of illustration and not limitation, and the present invention is limited only by the claims that follow.

What is claimed is:

1. A method for manufacturing cigarette cartons, said method comprising the steps of:

forming a bundle comprising a plurality of cigarette packs;

wrapping packaging stock about each cigarette pack bundle to form a wrapped bundle, said wrapping step including the step of folding side flaps over opposite sides of the cigarette pack bundle; said packaging stock having preapplied, heat-activated adhesive; said wrapping step including the step moving wrapped bundles along a path, each wrapped bundle remaining for a predetermined dwell-time at locations along said path during said moving step;

activating the pre-applied adhesive adjacent said folded side flaps by contacting said opposite sides of said wrapped bundle with a heating element while said wrapped bundle remains at a first location along said path; and setting the activated, pre-applied adhesive by contacting said opposite sides of said wrapped bundle with a cooling element while said wrapped bundle remains at a subsequent location along said path downstream of said first location.

2. The method as claimed in claim 1, wherein said heat activation step further comprises contacting said opposite sides with additional heating elements while said wrapped bundle remains at an additional location along said path between said first location and said subsequent location.

3. The method as claimed in claim 2, wherein said setting step further comprises contacting said opposite sides with additional cooling elements at a location along said path downstream of said subsequent location.

* * * * *